United States Patent [19]

Dixon et al.

[11] 4,142,593

[45] Mar. 6, 1979

[54] RAISE DRILL INNER YOKE BRIDGE

[75] Inventors: Robert L. Dixon, Brea; Malcolm D. Maxsted, Harbor City, both of Calif.; Jackson M. Kellner, Midland, Tex.

[73] Assignee: Smith International, Inc., Newport Beach, Calif.

[21] Appl. No.: 844,694

[22] Filed: Oct. 25, 1977

[51] Int. Cl.[2] ..... E21C 23/00

[52] U.S. Cl. ..... 175/53; 175/320; 175/344

[58] Field of Search ..... 175/53, 320, 340, 344, 175/374, 375; 299/41, 90

[56] References Cited

U.S. PATENT DOCUMENTS

| | | | |
|---|---|---|---|
| 3,221,619 | 12/1965 | Erickson | 299/41 X |
| 3,451,722 | 6/1969 | Scaravilli et al. | 299/90 |
| 3,750,767 | 8/1973 | Pessier | 175/53 |
| 3,920,089 | 11/1975 | Mitchell | 175/53 |
| 3,921,734 | 11/1975 | Goodfellow | 175/53 X |
| 3,971,447 | 7/1976 | Ahlberg et al. | 175/320 X |

*Primary Examiner*—Ernest R. Purser
*Assistant Examiner*—Nick A. Nichols, Jr.

[57] ABSTRACT

A raise drill is disclosed for enlarging a pilot hole into a large diameter hole by disintegrating the earth formations surrounding the pilot hole. The raise drill includes a bit body having a plurality of roller cutters mounted thereon. The bit body is detachable secured to a drive stem to permit removal and replacement of the stem. A shock absorbing element is interconnected between the drive stem and the bit body to enable the bit body to be flexibly mounted on the drive stem. A central yoke is provided to extend around the drive stem and interconnect the saddles of the two innermost cutters. The central yoke functions to distribute the loading of the inboard cutters. The central yoke can also function as a housing for a packing element.

4 Claims, 3 Drawing Figures

RAISE DRILL INNER YOKE BRIDGE

BACKGROUND OF THE INVENTION

1. Field of the Invention

The present invention relates generally to raise type earth boring drills and, more particularly, to such raise drills having shock elements for absorbing impact type loads passing through the drill.

2. Description of the Prior Art

A relatively large diameter hole may be provided between two locations in a mine by an operation commonly referred to as raise drilling. A raise drilling operation begins by drilling a small diameter pilot hole through the earth between the locations using a small diameter pilot bit. After the pilot hole is completed, the pilot bit is removed from the drill column and a large diameter raise bit is attached. The raise bit is then rotated and drawn along the pilot hole to enable the drill cutters to contact and disintegrate the earth formations surrounding the pilot hole, thereby enlarging the pilot hole to the desired size. In an exemplary embodiment, the pilot hole may be 11 inches in diameter and the reamed out hole may be six feet in diameter.

During a raise drilling operation, a tremendous amount of wear and stress is imposed upon the raise bit. The drive stem in particular is subjected to considerable wear due to abrasive contact with the surrounding earth formation and is also subject to considerable stress resulting from (a) tension due to the pulling force imparted to the drill, (b) twisting due to the torque applied to the drill, and (c) bending due to uneven loading around the circumference of the drill. Because of this considerable wear, many raise drills have the drive stems replaceable mounted on the bit body, thereby extending the useful life of the bit. The low profile of the separated components allows the raise bit to be transported through small drifts or passages.

The disadvantage of the replaceable drive stem is that a certain amount of down time is still required to remove and replace the stem. This non-operating time is costly and it is still preferable to obtain as long a running time as possible for each bit-stem combination.

As a result other features have been incorporated into the raise drill which have prolonged the operating life of such drills. One such feature has been the addition of an elastomeric shock element for absorbing the impact type loads passing through the drill. One such shock absorbing system is described in Assignee's copending application Ser. No. 833,040, filed Sept. 14, 1977. However, with the utilization of such a component, the drill bit body is relatively movable with respect to the drive stem. As a result, the inboard cutters, which are normally connected and anchored to the drive stem for stabilization and load bearing purposes, cannot now be anchored to the drive stem and still have the bit body flexible mounted.

SUMMARY OF THE INVENTION

The present invention obviates this inboard cutter stabilization problem by providing a central yoke extending around the drive stem which interconnects the saddles of the two innermost cutters.

The advantage of the present invention is that any uneven loading acting on one of the inboard cutters can be transferred to the other via the central yoke.

Another advantage of the present invention is that the central yoke can provide a housing for a flexible bearing.

The features of the present invention, which are believed to be novel, are set forth with particularity in the appended claims. The present invention, both as to its organization and manner of operation, together with the further advantages thereof, may best be understood by reference to the following description taken in connection with the accompanying drawings.

DESCRIPTION OF THE PREFERRED EMBODIMENT

Figure 1:
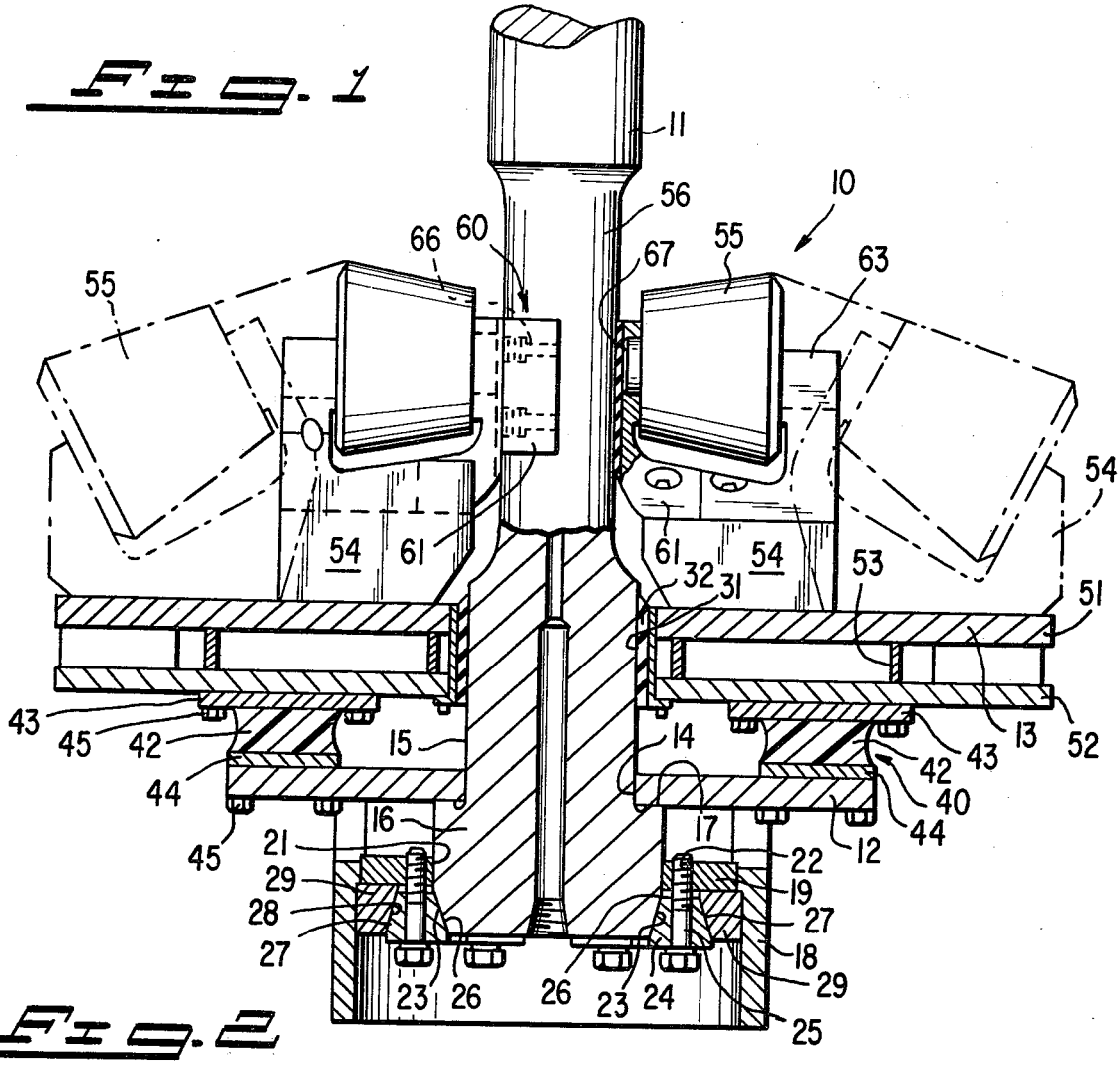
FIG. 1 is a section view of a raise bit having an inner yoke bridge in accordance with the present invention.
Figure 2:
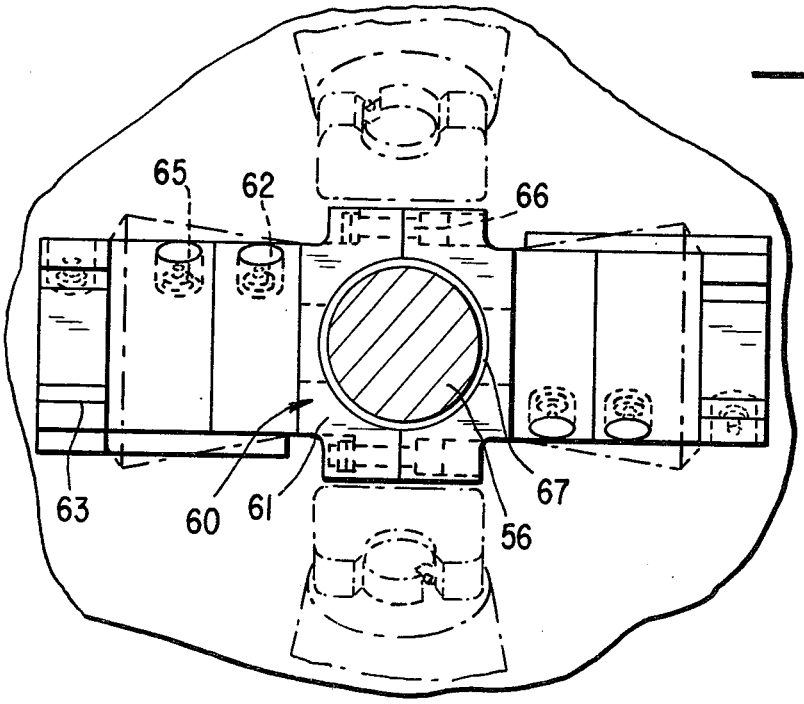
FIG. 2 is a fragmentary plan view, partially in section of the inner yoke bridge of the present invention.

Referring now to the drawings, FIGS. 1 and 2 illustrate a raise drill generally indicated by arrow 10, comprising a drive stem 11, a thrust plate 12, and a bit body 13. The upper end of the drive stem 11 is provided with a tapered thread (not shown) which is adapted to be threaded into a standard drill string through which the raise drill 10 is driven.

The thrust plate 12 has a central opening 14 which has a diameter only slightly larger than the central shank portion 15 of the drive stem 11. The central shank portion 15 is of a smaller diameter than the lower end 16 of the drive stem 11, forming an upwardly facing peripheral shoulder 17, against which the margin of the hole 14 in the thrust plate 12 fits when the thrust plate 12 is in the assembled position with the drive stem 11.

The drive stem 11 is removably attached to the raise drill assembly by means of the following assembly. The attaching assembly includes a cylindrical collar 18 which extends below the thrust plate 12 and is attached thereto. An annular plate 19 is located inside the collar 18 and is attached to the interior walls thereof. The annular plate 19 includes a central opening 21 which extends about the lower shank portion 16 of the drive stem 11. The annular plate 19 further includes a plurality of threaded bores 22 circumferentially positioned about the central opening 21. The lower shank portion 16 further includes a plurality of tapered flat surfaces 23 located about the periphery of the bottom end thereof.

A plurality of wedge blocks 24 are provided with each wedge block 24 having a bore extending therethrough for receiving a threaded bolt 25. The bolts 25 are adapted to be attached to the threaded bores 22 located on the annular plate 19. Each wedge block 24 further includes a first inwardly facing tapered surface 26 for engagement with the respective flat surface 23 of the drive stem 11. Each wedge block 24 further includes a second outwardly facing tapered surface 27, diametrically opposed to the first tapered surface 26. The second tapered surface 27 is adapted to engage a tapered surface 28 of a registering block 29 which is positioned within the collar 18 adjacent a respective wedge block 24. The blocks 29 are integrally attached to the collar 18 and annular plate 19.

The bit body 13 further includes a central opening 31 which extends around the central shaft portion 15 of the drive stem 11. An annular packing member 32 is located between the central opening 31 and the central shaft portion 15.

The thrust plate 12 and the bit body 13 are interconnected by means of an elastomeric element generally indicated by arrow 40. The elastomeric element 40 comprises a substantially toroidal element 42 coaxially positioned with respect to the drive stem 11. The toroidal element 42 is made of a polyurathane material which is sandwiched between a pair of plates 43 and 44 which are of a similar toroidal configuration. The toroidal element 42 is of polyurathane material which is bonded to the plates 43 and 44 to form an integral unit. The toroidal configuration of elements 42 and plates 43 and 44 are divided into four equal 90° segments. The plates 43 and 44 include a plurality of threaded bore holes which are adapted to receive a plurality of bolts 45 for connection to the thrust plate 12 and the bit body 13.

The bit body is comprised mainly of a pair of parallel plates 51 and 52 rigidly secured to each other by a plurality of ribs 53 to form a frame. The upper plate 51 has a plurality of saddles 54 integrally mounted thereon for rotatively supporting a plurality of rolling cutters 55. In accordance to the present invention, the two innermost cutters are interconnected by means of an inner yoke bridge, generally indicated by arrow 60, which extends around shaft portion 56.

Figure 3:
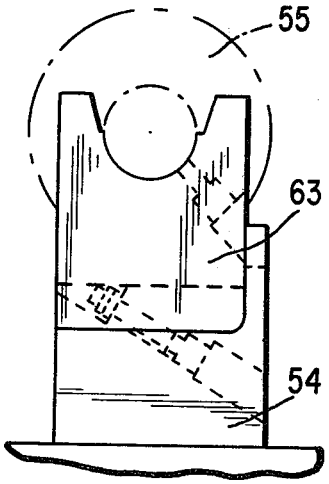
FIG. 3 is an elevational view of an inboard cutter mounting arrangement.

As shown in FIGS. 2 and 3, the inner yoke bridge 60 is made of two parts with each part forming the innermost bearing support 61 for the cutter 55 and is attachably mounted onto the base of the saddle 54 by means of a bolt connection 62. In a similar manner, the outermost bearing support 63 for each cutter 55 is also attachably mounted on the base of the saddle 54 by means of a bolt connection 65, thereby forming a three part saddle comprised of elements 54, 61 and 63. As more clearly shown in FIG. 2, each part 61 of the inner bridge yoke 60 extending away from the cutter 55 extends around shaft portion 56 of the drive stem 11 and mates with adjoining faces. These two elements 61 are then interconnected by means of a pair of bolt connections 66.

A clearance is provided between the inner annular face of the yoke bridge 60 and the drive stem 11. Such clearance can be used as a gap or else as a means for housing an elastomeric packing 67 being connected thereto.

OPERATION

The raise drill 10 is utilized in a raise drilling operation to provide a relatively large diameter hole between two levels in a mine. The raise drilling operation begins by drilling a small diameter pilot hole through the earth from a first location to an opening at a second location, using a small diameter pilot bit. After the pilot hole is completed, the pilot bit is removed from the drill column and the raise bit 10 is attached to the drill collar. The raise bit 10 is rotated and drawn along the pilot hole to enable the cutters 55 to contact and disintegrate the earth formations surrounding the pilot hole, thereby enlarging the pilot hole to the desired size.

The raise bit 10 may be transported through small drifts or passages by removing the drive stem 11 and transporting the drive stem 11 and the raise bit body 13 through the small drifts or passages separately. In removing the drive stem 11, the yoke connection 60 is first removed. Afterwards, the bolts 25 are removed utilizing conventional torque tools. Upon removal of the bolts 25 and wedge block 24, the drive stem 11 is lowered through the central openings of the thrust plate 12 and the bit body 13 out of engagement therewith. The separate elements of the raise bit 10 may then be transported separately through the small drifts or passages.

When the raise bit 10 is to be connected to the drill column, the drill stem 11 is inserted through the central openings 14 and 21, respectively, until the shoulder 17 engages the margin of the thrust plate 12 around the central opening 14.

The wedge blocks 24 are then positioned as shown in the drawing and the bolts 25 are then threaded into engagement with the plate 19 to urge the wedge blocks 24 into engagement with the flat tapered surfaces 26 of the drive stem 11 and the tapered surfaces 28 of the blocks 29. The bolts 25 are tightened individually to enable the wedge components to be properly aligned. Upon tightening of the bolts 25 and installing the yoke connection 60, the raise bit is then ready for operation.

The elastomeric element 40 is interconnected between the thrust plate 12 and the bit body 13 to absorb the bending forces due to the unequal loading around the circumference of the drill. The elastomeric element 40 is also designed to transmit all of the thrust and torsional loads from the drill stem 11 to the raise bit body 13. The vertical thrust from the drill stem 11 is transmitted to the thrust plate 12 by the shoulder connection 17 and then through the elastomeric element 40 to the bit body 13. The torque is transmitted from the drill stem 11 through the connection assembly to the collar 18 and the thrust plate 12 which is integrally connected thereto. The torque is then transmitted through the elastomeric element 40 to the bit body 13.

In accordance with the present invention, the inner yoke bridge 60 functions to stabilize the forces acting on the inboard cutters 55 by transferring any uneven or bending load action on one inboard cutter to the other.

The two elements 61 are separable by removing the bolts 66 and are removable from the rest of the cutter saddle construction by removing the bolts 62.

The inner yoke bridge 60 also enables the bit body 13 to be relatively movable with respect to the drive stem 11 since the bridge 60 is not anchored to the drive stem 11. However, the bridge 60 still enables the inboard cutters 55 to be stabilized in substantially the same manner.

It should be noted that various modifications can be made to the assembly while still remaining within the purview of the following claims.

What is claimed is:

1. A raise drill comprising:

a drive stem having means at one end thereof for connecting to a drill string;

a bit body having a plurality of rolling cutter assemblies mounted thereon in a radially spaced relationship, at least two of the cutter assemblies being located inboard of the other cutter assemblies, each roller cutter assembly comprising a saddle mounted on said bit body, said saddle having a pair of yokes extending upwardly for rotatively supporting a rolling cutter, shock absorbing means interconnected between said drive stem and said bit body for absorbing the impact loads therebetween, said shock absorbing means enabling said bit body to be relatively movable with respect to said drive stem; and means extending around said drive stem for interconnecting said inboard cutter assemblies and distributing the loads acting thereon, said load distribution means comprising a bridge member having a hollow cylindrical opening slightly larger than the diameter of said drive stem, said bridge member comprising two separable parts.

2. The combination of claim 1 wherein said bridge member further includes packing material located within said opening and around said drive stem.

3. The combination of claim 1 wherein said bridge member forms a portion of the innermost yokes supporting the inboard cutters.

4. The combination of claim 3 wherein said bridge member is separable from the remaining portions of said innermost yokes.

* * * * *